US009289343B2

(12) United States Patent
Schleitzer et al.

(10) Patent No.: US 9,289,343 B2
(45) Date of Patent: Mar. 22, 2016

(54) RESILIENT SIDE RAILS FOR MEDICAL TABLES

(75) Inventors: Patrick Schleitzer, Unterwellenborn (DE); Orlando Soto, Salem, MA (US); Edward Daley, Mount Pleasant, SC (US)

(73) Assignee: Trumpf Medizin Systeme GmbH + Co. KG, Saalfeld (DE)

( * ) Notice: Subject to any disclaimer, the term of this patent is extended or adjusted under 35 U.S.C. 154(b) by 410 days.

(21) Appl. No.: 13/428,673

(22) Filed: Mar. 23, 2012

(65) Prior Publication Data

US 2013/0247299 A1 Sep. 26, 2013

(51) Int. Cl.
*A47B 71/00* (2006.01)
*A61G 13/10* (2006.01)

(52) U.S. Cl.
CPC ..... *A61G 13/101* (2013.01)

(58) Field of Classification Search
CPC ..... A61G 13/101
USPC ..... 5/600, 601, 603, 621, 663
See application file for complete search history.

(56) References Cited

U.S. PATENT DOCUMENTS

| | | | | |
|---|---|---|---|---|
| 5,628,080 | A * | 5/1997 | Quintile | 5/663 |
| 6,470,520 | B1 | 10/2002 | Weismiller et al. | |
| 7,412,311 | B2 | 8/2008 | Georgi et al. | |
| D604,422 | S | 11/2009 | Albrecht et al. | |
| 7,761,939 | B2 * | 7/2010 | Wiggins et al. | 5/430 |
| 7,784,126 | B2 | 8/2010 | Meissner et al. | |
| 2004/0148703 | A1 | 8/2004 | Doering et al. | |
| 2004/0200001 | A1 | 10/2004 | Stolze et al. | |
| 2004/0216233 | A1 | 11/2004 | Ludwig et al. | |
| 2006/0103226 | A1 | 5/2006 | Wong et al. | |
| 2007/0107122 | A1 | 5/2007 | Georgi et al. | |
| 2007/0107129 | A1 | 5/2007 | Burstner et al. | |
| 2008/0034502 | A1 | 2/2008 | Copeland et al. | |
| 2008/0289113 | A1 * | 11/2008 | Berrocal et al. | 5/658 |
| 2010/0011504 | A1 | 1/2010 | Hegarat et al. | |
| 2010/0293719 | A1 | 11/2010 | Klemm et al. | |
| 2012/0204885 | A1 | 8/2012 | Koch | |
| 2013/0247299 | A1 * | 9/2013 | Schleitzer et al. | 5/600 |
| 2013/0247301 | A1 * | 9/2013 | Daley et al. | 5/613 |

FOREIGN PATENT DOCUMENTS

| | | | |
|---|---|---|---|
| DE | 202011000308 | U1 | 5/2011 |
| EP | 1295583 | A2 | 3/2003 |
| WO | WO2006034914 | A1 | 4/2006 |

OTHER PUBLICATIONS

Notification of Transmittal of the International Search Report and the Written Opinion for corresponding PCT Application No. PCT/IB2013/000967, mailed Feb. 6, 2014, 18 pages.

"Polytechnisch Zakboek, Passingen", Jan. 1, 2002, Elsevier, Arnhem, XP002712683.

(Continued)

*Primary Examiner* — David E Sosnowski
(74) *Attorney, Agent, or Firm* — Fish & Richardson P.C.

(57) ABSTRACT

This disclosure relates to resilient side rails for medical tables. In some aspects, a side rail for a medical table includes an elongated body having a height and a width that are configured to be received by a medical accessory, and the elongated body is formed of a material having a modulus of elasticity that is about 50 gigapascals to about 150 gigapascals and a yield strength that is about $40\times10^7$ pascals to about $120\times10^7$ pascals.

45 Claims, 8 Drawing Sheets

(56) References Cited

OTHER PUBLICATIONS

Notification of Transmittal of the International Search Report and the Written Opinion of the International Searching Authority for corresponding PCT Application No. PCT/IB2013/000972, mailed Oct. 14, 2013, 53 pages.

"Engineering Properties of Electroless Nickel Coatings", May 19, 1983, retrieved from the internet: http://www.techmetals.com/InternetArticles/Engineering%20Properties%20of%20EN%20Coatings.pdf.

* cited by examiner

RESILIENT SIDE RAILS FOR MEDICAL TABLES

TECHNICAL FIELD

This disclosure relates to resilient side rails for medical tables.

BACKGROUND

Tables and beds for supporting patients during medical procedures (e.g., operating room tables) can include various accessories that are used to aid medical staff member during a medical procedure. The tables and beds can include side rails that are configured to temporarily receive one or more accessories.

SUMMARY

In an aspect, a side rail for a medical table includes an elongated body having a height and a width that are configured to be received by a medical accessory. The elongated body is formed of a material having a modulus of elasticity that is about 50 gigapascals to about 150 gigapascals and a yield strength that is about $40\times10^7$ pascals to about $120\times10^7$ pascals.

In another aspect, a medical table system includes a table that is configured to support a patient during a medical procedure and that defines a patient support surface. The medical table system further includes a side rail disposed along an outer surface of the table. The side rail includes an elongated body having a height and a width that are configured to be received by a medical accessory. The elongated body is formed of a material having a modulus of elasticity that is about 50 gigapascals to about 150 gigapascals and a yield strength that is about $40\times10^7$ pascals to about $120\times10^7$ pascals.

In a further aspect, a side rail for a medical table includes an elongated body having a height and a width that are configured to be received by a medical accessory. The side rail is configured so that when the side rail is supported along a first, wide side by two support members that are about 300 mm apart and a 500 newton force is applied midway between the support members to a second, opposite side of the side rail, a maximum deflection of the side rail is less than about 5 mm, and when the force is released, the side rail rebounds and substantially no permanent deformation of the side rail occurs.

In an additional aspect, a medical table system includes a table that is configured to support a patient during a medical procedure and that defines a patient support surface. The medical table system further includes a side rail disposed along an outer surface of the table. The side rail includes an elongated body having a height and a width that are configured to be received by a medical accessory. The side rail is secured to the table using a force absorbing member that is configured to permit the side rail to deflect towards the table when energy of about 5 Joules to about 100 Joules is applied to the side rail and to absorb some of the energy applied to the side rail as the side rail deflects towards the table.

Embodiments can include one or more of the following features.

In some embodiments, the height is about 25 mm to about 30 mm (e.g., about 28.6 mm) and the width is about 8 mm to about 10 mm (e.g., about 9.5 mm).

In certain embodiments, the material has a modulus of elasticity that is about 50 gigapascals to about 80 gigapascals and a yield strength that is about $40\times10^7$ pascals to about $60\times10^7$ pascals.

In some embodiments, the material is 7075-T6 Aluminum.

In certain embodiments, the material has a modulus of elasticity that is about 100 gigapascals to about 130 gigapascals and a yield strength that is about $100\times10^7$ pascals to about $120\times10^7$ pascals.

In some embodiments, the material is Ti5 Titanium.

In certain embodiments, the side rail further includes a metal plating that substantially covers the elongated body.

In some embodiments, the metal plating includes a nickel based material.

In certain embodiments, the metal plating is an electroless nickel plating that is about 0.025 mm thick.

In some embodiments, when the side rail is supported along a first, wide side by two support members that are about 300 mm apart and a 500 newton force is applied midway between the support members to a second, opposite side of the side rail, a maximum deflection of in the side rail is less than about 5 mm, and when the force is released, the side rail rebounds and substantially no permanent deformation of the side rail occurs.

In certain embodiments, the medical table is an operating room table.

In some embodiments, the maximum deflection is less than about 3.0 mm.

In certain embodiments, the force absorbing member provides a resisting force having a spring force constant that is about 50 N/mm to about 200 N/mm.

In some embodiments, the force absorbing member is a spring.

In certain embodiments, the spring is washer spring.

In some embodiments, the spring force constant of the spring is about 50 N/mm to about 200 N/mm.

In certain embodiments, the energy is about 50 Joules to about 100 Joules.

In some embodiments, the energy is the result of an impact with another object.

Embodiments can include one or more of the following advantages.

The medical table side rails described herein can withstand greater impact forces than certain conventional operating room table side rails without substantially permanently deforming. Such improved impact performance can be achieved by forming the side rails of one or more materials that are flexible (e.g., have a low modulus of elasticity) yet also resistant to permanent deformation (e.g., have a high yield strength).

The medical table side rails described herein can also be lighter than certain conventional operating room table side rails that are approximately the same size. The lower weight side rails can reduce the overall weight of the table making it easier for medical staff members to move the table. This can be particularly beneficial for modular table systems that include removable patent support surface segments.

The details of one or more embodiments of the invention are set forth in the accompanying drawings and the description below. Other aspects, features, and advantages will be apparent from the description and drawings, and from the claims.

DETAILED DESCRIPTION

Medical tables (e.g., operating tables) can include side rails that serve as mounting points for accessories (e.g., surgical accessories). The side rails described herein are made of materials that permit them to withstand impacts (e.g., as a result of the operating tables colliding with other objects) without permanently deforming as a result of the impact.

Figure 1:
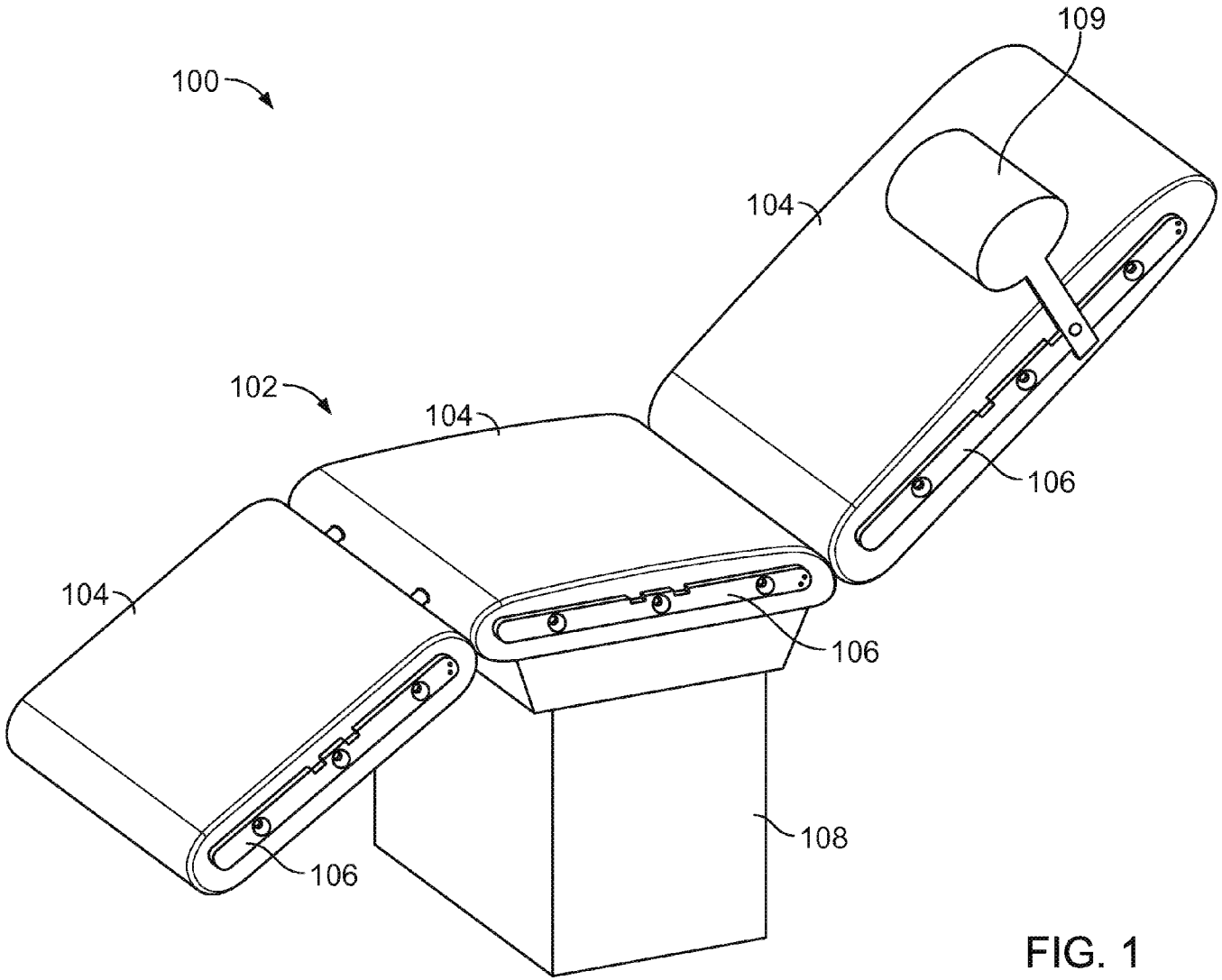
FIG. 1 is a perspective view of a medical table having side rails.

Referring to FIG. 1, a medical table (e.g., operating table) 100 includes a patient support surface (e.g., a table top assembly) 102 made of three support surface segments (e.g., table top components) 104. The support surface segments 104 are configured to move relative to one another to adapt the patient support surface 102 to various desired operating table orientations. The various operating table orientations can depend on specific procedures that a patient on the table 100 is to undergo. The support surface segments 104 are attached to a support base 108 that can control the movement and orientation of the support surface segments 104 relative to one another. For example, the support base 108 can include movement devices (e.g., electromechanical or pneumatic drives) connected to the support surface segments 104 and a control unit that is in communication with the movement devices and that is configured to control the movement of the support surface segments 104.

Each support surface segment 104 includes a side rail 106 secured (e.g., fastened) to a side region of the support surface segment 104 to provide a mounting location for accessories, such as a surgical accessory. While FIG. 1 only shows the side rails 106 extending from the left sides of the support surface segments 104, it should be understood that each of the support surface segments 104 typically includes a side rail 106 on both of its sides. Examples of surgical accessories include tool holders (e.g., surgical tool holders), patient support apparatuses (e.g., headrests, lateral patient supports, arm boards, knee crutches), and other medical accessories. A headrest 109 is shown attached to the table 100 in FIG. 1. As shown, the accessory (patient headrest) 109 can be secured to one of the side rails 106. Using the side rails 106, the accessory 109 can be arranged (e.g., slid) onto the side rails 106, positioned at a desired location relative to the operating table 100, and then secured (e.g., fastened) to the side rail 106. The accessory 109 can also be released (e.g., loosened) from the side rail 106, repositioned (e.g., slid) along the side rail 106 to a next, alternative location based on the various needs of the patient or the operating room staff, and then re-secured to the side rails 106.

The side rails 106 are fastened to the support surface segment 104 using spacers (e.g., standoffs) such that the side rails 106 are spaced from the support surface segment 104. The spacing from the support surface segment 104 is generally large enough to provide mounting clearance for the accessories to be mounted along the side rail 106. For example, the spacers (e.g., standoffs) can provide a spacing that is about 0.375 inch to about 1 inch from the support surface segments 104.

Figure 2:
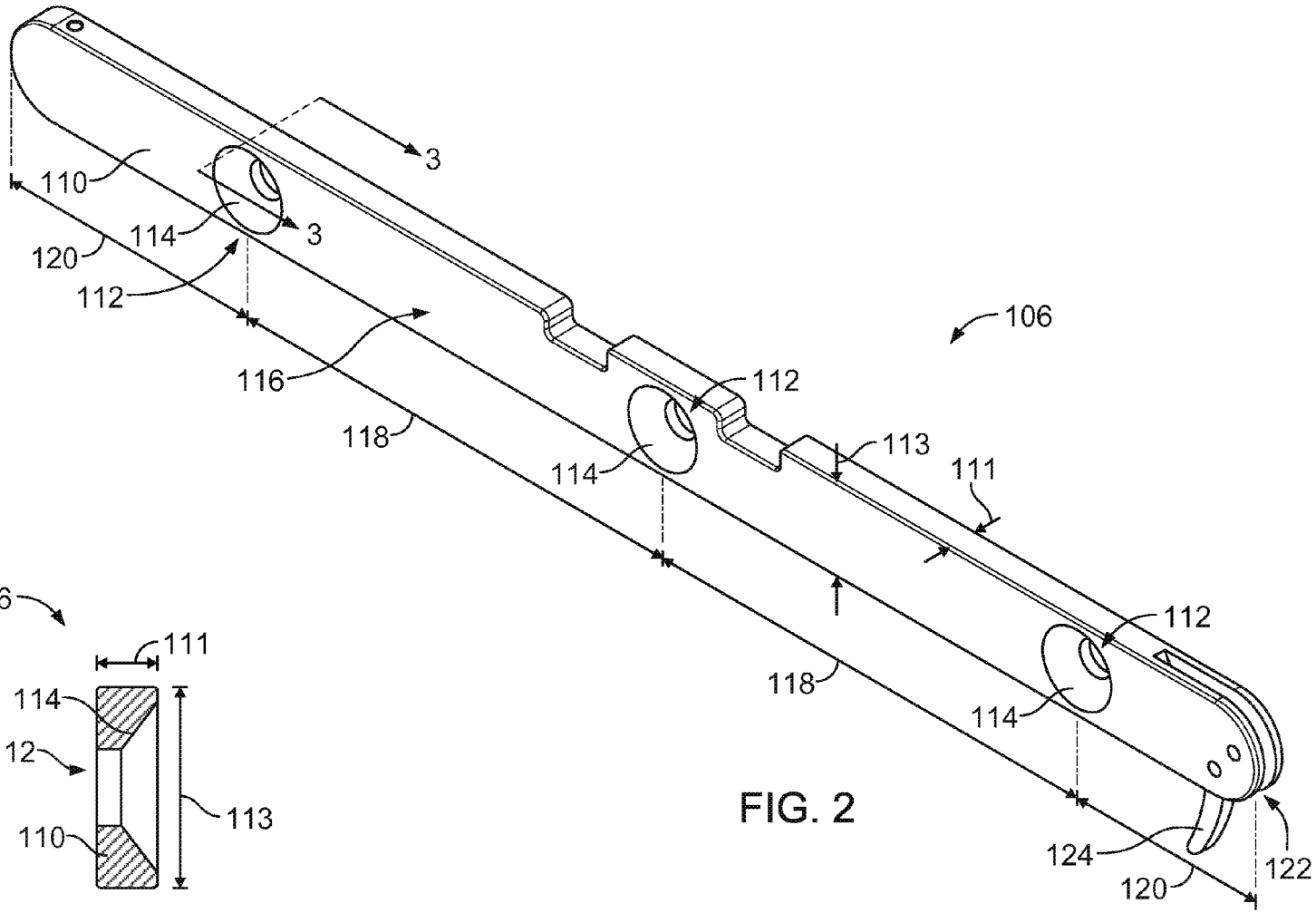
FIG. 2 is a perspective view of one of the side rails of FIG. 1 with an accessory lock extending from one end region of the side rail.

FIG. 2 is a perspective view of one of the example side rails 106 of the table 100. The side rail 106 includes an elongated member 110 that is configured to permit the accessory 109 to be attached (e.g., releasably attached) for use. As discussed below, the elongated member 110 can be formed of a resilient elongated body that is coated (e.g., plated) with a harder material. The cross-sectional size and shape of the side rail 106 are typically chosen to conform to one or more regulatory or industry standards for the size and shape of operating table accessories.

Figure 3:
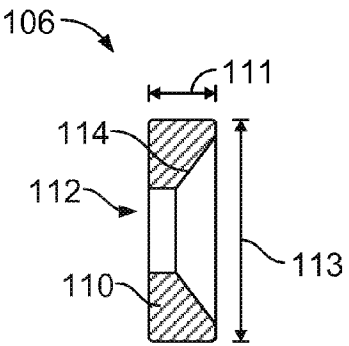
FIG. 3 is a cross-sectional view of the side rail for FIG. 2.
Figure 4:
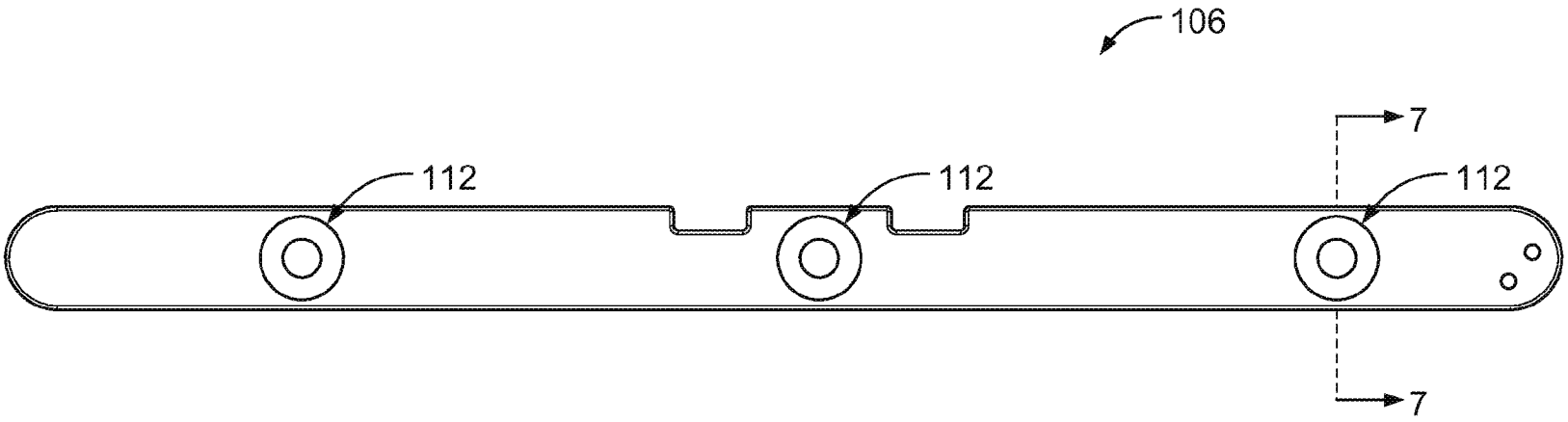
FIGS. 4-6 are front, bottom, and cross-sectional views, respectively, of a side rail that was subjected to tests described herein.
Figure 5:
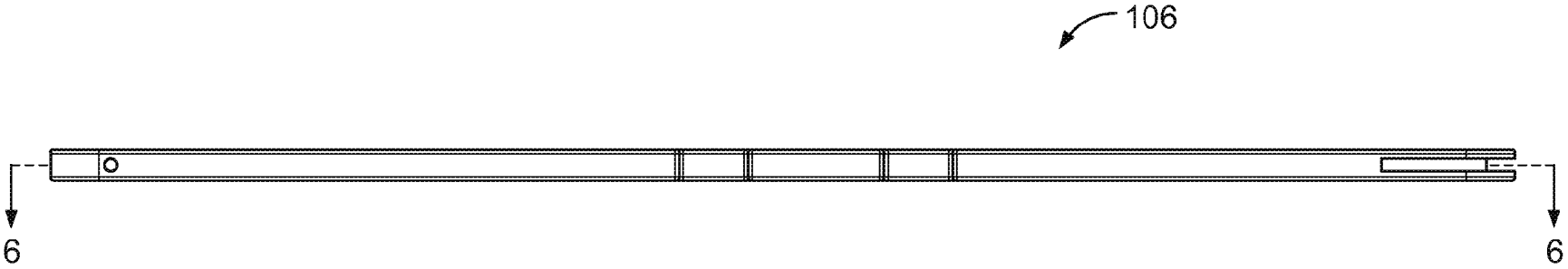
Figure 6:
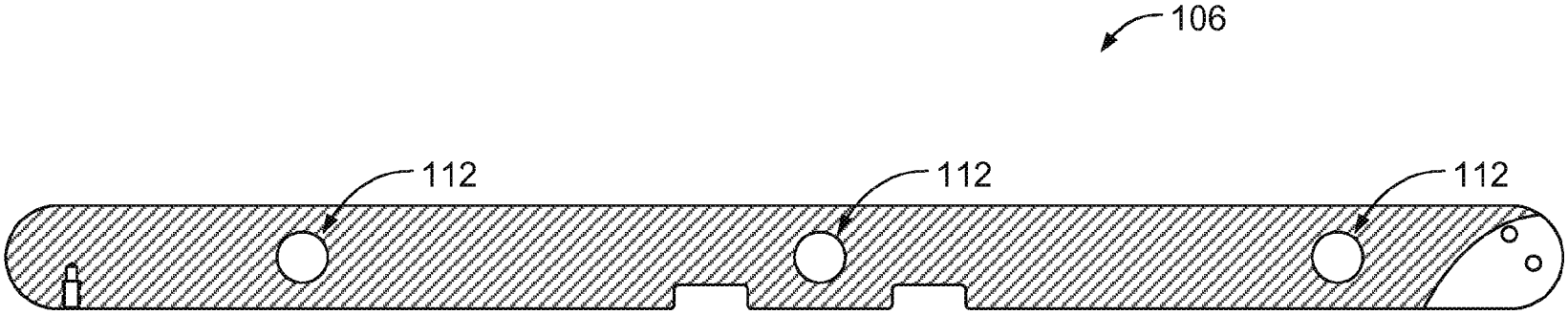
Figure 7:
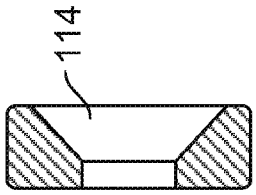
FIG. 7 is a cross-sectional view of a mounting hole of the test side rail of FIGS. 4-6.

As shown in FIGS. 2 and 3, the elongated member 110 has a generally rectangular cross-sectional shape having a width 111 and a height 113 to be received in a recess of an operating table accessory. The width 111 of the elongated member 110 is typically about 6 mm to about 20 mm (e.g., about 8 mm to about 10 mm) and the height 113 of the elongated member 110 is typically about 20 mm to about 35 mm (e.g., about 25 mm to about 30 mm). The size of the side rail 106 is anticipated to be suitably received within some standard operating room table accessories, such as standard accessories that are available and used in the U.S.

The side rail 106 includes three mounting holes 112. The mounting holes 112 are sized and configured to structurally secure the side rail 106 to one of the support surface segments 104, for example, using fasteners that pass through standoffs and into threaded holes in the support surface segments 104. The mounting holes 112 include recesses (e.g., countersunk recesses) 114 that are sized and configured to receive a portion (e.g., a fastener head) of the fasteners used to secure the side rail 106 to the support surface segment 104. The countersunk recess 114 is typically sized to receive the head of a fastener so that the head lies generally flush with an outer surface 116 of the side rail 106 so that the head of the fastener does not extend beyond the outer surface 116. For example, the mounting holes 112 and the countersunk recesses 114 can be sized and configured to receive and accommodate a flat head cap screw, such as an M10 flat head cap screw.

The mounting holes 112 are spaced apart along the side rail 106 by an inner spacing distance 118. The inner spacing distance is typically small enough to provide adequate structural support limiting the amount that the side rail 106 can flex or deflect during typical use, such as when forces are applied when the accessory 109 is attached to the side rail 106 and supported during use. However, the inner spacing distance 118 is typically large enough so that the side rail 106 is able to flex as a result of impact forces, for example, if an object bumps into the side rail 106 on the operating table 100. Therefore, the desired inner spacing distance 118 can be influenced by the size and shape (e.g., the height and width) of the side rail 106 and the materials from which portions of the side rail 106 (e.g., the elongated body and the plating of the elongated member 110 of the side rail 106) are made. Additionally, the inner spacing distance 118 between the mounting holes 112 can also be determined by regulatory agency specifications or by the manufacturer of the operating table on which the side rail 106 is used. The inner spacing distance 118 is typically about 300 mm or less (e.g., about 50 mm to about 300 mm, about 100 mm to about 250 mm, about 130 mm to about 190 mm).

The mounting holes 112 that are arranged closest to the ends of the side rail 106 are typically spaced apart from the ends of the side rail 106 by an outer spacing distance 120. Like the inner spacing distance 118, the outer spacing distance 120 is typically small enough to provide structural stability for an accessory 109 secured near the end of the side rail 106 during use. However, the outer spacing distance 120 is typically large enough to permit the end of the side rail to flex, for example, when inadvertently bumped into by another piece of equipment. The outer spacing distance 120 is typically about 150 mm or less (e.g., about 35 mm to about 150 mm, about 55 mm to about 90 mm).

The side rail 106 can include accessory retention devices (e.g., an accessory lock) to help prevent accessories from sliding off of the side rail 106, for example, as a result of the table 100 moving. For example, as shown in FIG. 2, the side rail 106 includes a gravity controlled accessory lock 122 to prevent an accessory from inadvertently sliding off of the side rail 106. The accessory lock 122 includes a pivoting finger 124 that is able to swing inward towards the side rail 106, for example, as an accessory is slid onto the side rail 106. However, the pivoting finger 124 is generally obstructed from swinging away from the side rail 106 beyond an angular position relative to a longitudinal axis of the side rail 106 that would permit an accessory to slide off of the side rail 106. For example, the pivoting finger 124 shown is not able to pivot away from the side rail 106 beyond the orientation shown in FIG. 1 (e.g., about 90 degrees relative to the longitudinal axis of the side rail 106). During use, an accessory may be slid onto the side rail 106 and the pivoting finger 124 swings upward towards the side rail 106 to pass through an opening of the accessory. However, if the accessory is inadvertently slid towards the end of the side rail 106, the hanging pivoting finger 124, which would fall downward under the force of gravity after the accessory is slid beyond the pivoting finger 124, would block the accessory from falling off the side rail 106. If a user wanted to remove the accessory, the pivoting finger 124 can be manually pivoted into the side rail 106 and the accessory can be removed.

As noted above, the elongated member 110 of the side rail 106 is typically formed of an elongated resilient body that is plated with a different (e.g., harder) material than the material of the elongated body. The elongated member 110 provides suitable structural strength to support the various accessories 109 that are secured to the side rail 106 during use, but is also generally able to withstand an impact force (e.g., as a result of an inadvertent collision with another object) without permanently deforming. To withstand impact forces, the material of the elongated body is generally resilient and flexible so that the side rail 106 can deflect under higher, impact loads, for example, side loads applied to the side rail 106. As a result of its flexibility and resilience, the side rail 106 is anticipated to be damaged (e.g., permanently deformed) less frequently, thus reducing required maintenance of the side rails 106 and the table 100 as a whole. For example, side rails made of materials having a modulus of elasticity, which is a measure of a material's stiffness, that is about 50 gigapascals ("GPa") to about 150 GPa have been shown to provide suitable flexibility in order to permit the side rail to deflect under most expected impact forces.

In combination with the flexibility of the side rail 106 as a result of the lower modulus of elasticity, the material is also selected to have the ability to flex without permanently deforming. Therefore, the material has a high yield strength, which is a measure of the material's ability to resist plastic (e.g., permanent) deformation under stress. For example, side rails made of materials having a yield strength that is about $40\times10^7$ pascals ("Pa") to about $120\times10^7$ Pa have been shown to have suitable resistance to permanent deformation.

Materials that possess this combination of a relatively low modulus of elasticity permitting deflection under an applied force and a high yield strength limiting permanent deformation when deflected have been shown to exhibit superior impact performance over side rails made of certain conventional materials, such as stainless steels. Examples of materials that possess combinations of modulus of elasticity and yield strength within the above-referenced ranges include certain aluminums, such as aircraft aluminum (Al 7075-T6) and certain titaniums, such as Ti5 Titanium.

As discussed above, the elongated body of the elongated member 110 of the side rails 106 is typically plated with another harder material. The plated material can provide protection from and resistance to wear and corrosion of the underlying, inner material which can help increase durability of the side rail 106. For applying a suitably plated material to the elongated body that provides adequate wear and corrosion protection, the plated material is typically applied according to one or more regulatory standards, such as ASME plating standards. The elongated body is typically nickel plated. For example, the elongated body can be plated with a 0.025 mm thick electroless nickel medium phosphour plated material.

EXAMPLE

Testing

FIGS. 4-7 illustrate a specific example of a side rail 106 (e.g., showing specific dimensions in mm) that was subjected to the testing to be described below. The tested side rail 106 was made of 7075-T6 Aluminum with a mid-phosphorus electroless nickel plating having a thickness of about 0.25 mm. The tested side rail 106 was manufactured to have a cross-sectional size and shape that conformed with typical side rail norms used in the U.S. Specifically, the side rail 106 was about 9.5 mm wide, about 28.6 mm high, and about 429 mm long. The three mounting holes 112 of the tested side rail 106 were longitudinally spaced apart by about 142.5 mm. The tested side rail 106 was subjected to a series of tests, including deflection tests and an impact test to analyze the side rail's ability to withstand various loads.

Deflection Testing

The tested side rail 106 was deflection tested according to EN ISO 19054:2006. Summaries of the test procedures and the corresponding results for each of the deflection tests are provided below in Table 1. Instruments that were used during testing are described below in Table 2.

TABLE 1

| Test No. | Test Procedure | Results |
|---|---|---|
| 1 | The rail is supported along its narrow face by two supports centered relative to the rail and spaced 300 mm apart. Opposite to the face, a load of 500N is applied on center in the downwards direction. | a) Maximum deflection was measured to be 0.36 mm - PASS.<br>b) No permanent deformation was observed after load was removed. |

TABLE 1-continued

| Test No. | Test Procedure | Results |
|---|---|---|
| 2 | The rail is supported along its wide face by two supports centered relative to the rail and spaced 300 mm apart. Opposite to this face, a load of 500N is applied on center in the downwards direction. | a) Maximum deflection was measured to be 2.4 mm - PASS. b) No permanent deformation was observed after load was removed. |
| 3 | The rail is fully supported between two supports spaced 300 mm apart. A torque load of 150 N-m along the axis of the rail is applied centered between the two supports. | a) Maximum deflection angle was measured to be 4 degrees - PASS. b) No permanent deformation was observed after load was removed. |
| 4 | The rail is fully supported on one end only resulting in a cantilevered rail that is 150 mm long. A load of 250N is applied at the end of the cantilevered rail in a direction normal to the narrow face of the rail. | a) Maximum deflection was measured to be 1.5 mm. b) No permanent deformation was observed after load was removed. |
| 5 | The rail is fully supported on one end only resulting in a cantilevered rail that is 150 mm long. A load of 250N is applied at the end of the cantilevered rail in a direction normal to the wide face of the rail. | a) Maximum deflection was measured to be 3.5 mm. b) No permanent deformation was observed after load was removed. |
| 6 | The rail is supported on one end only resulting in a cantilevered rail that is 150 mm long. A torque of 75 N-m is applied at the end of the cantilevered rail. | a) Maximum deflection angle was measured to be 4 degrees - PASS. b) No permanent deformation was observed after load was removed. |

TABLE 2

| Description | Manufacturer and Model | Serial Number |
|---|---|---|
| Digital Calipers | Mitutoyo CD-6"-CX | 06170600 |
| Height Gauge | Grizzly - 12" Height | N/A |
| Digital Scale | Rubbermaid 4040-88 | 4040-88-11405 |
| Granite Inspection Table | N/A | N/A |
| Inclinometer | Dasco Pro-Angle Finder | N/A |

Figure 8:
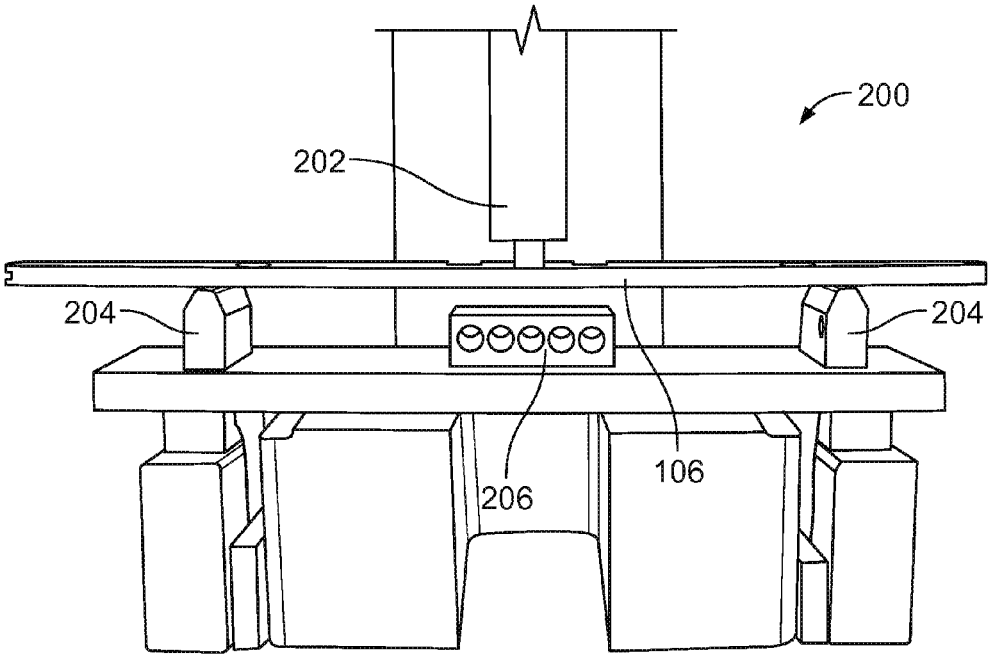
FIGS. 8-11 are diagrams of test setups used to perform deflection tests on the test side rail of FIGS. 4-6.

FIG. 8 illustrates a test setup 200 used to perform Tests 1 and 2. The digital scale was used to establish and verify a load input that would result in a consistent force of about 500 N output by an arbor press 202. A fixture was constructed such that the test side rail was supported by rail supports 204 separated by about 300 mm. Using the height gauge to measure change in the fixture height during loading, care was taken to help ensure that the fixture setup did not significantly deflect under the load. Little change (e.g., substantially no change) in height of the fixture setup was detected under the load. A gauge block 206 was placed under the test side rail 106 in order to establish a consistent surface from which deflection measurements of the test side rail 106 could be taken. The test side rail 106 was then subjected to a load of about 500 N applied to both the narrow and wide faces according to Test Procedures 1 and 2. Measurements of the resulting deflection were taken before, during, and after loading such that maximum deflection and rebound could be established. The deflection was measured using the height gauge and was confirmed using the digital calipers. As indicated in Table 1 above, for Test 1, the maximum deflection was 0.36 mm when the load was applied and no permanent deflection was observed in the test side rail 106 when the load was released. For Test 2, the maximum deflection was 2.4 mm when the load was applied and no permanent deflection was observed in the test side rail 106 when the load was released.

Figure 9:
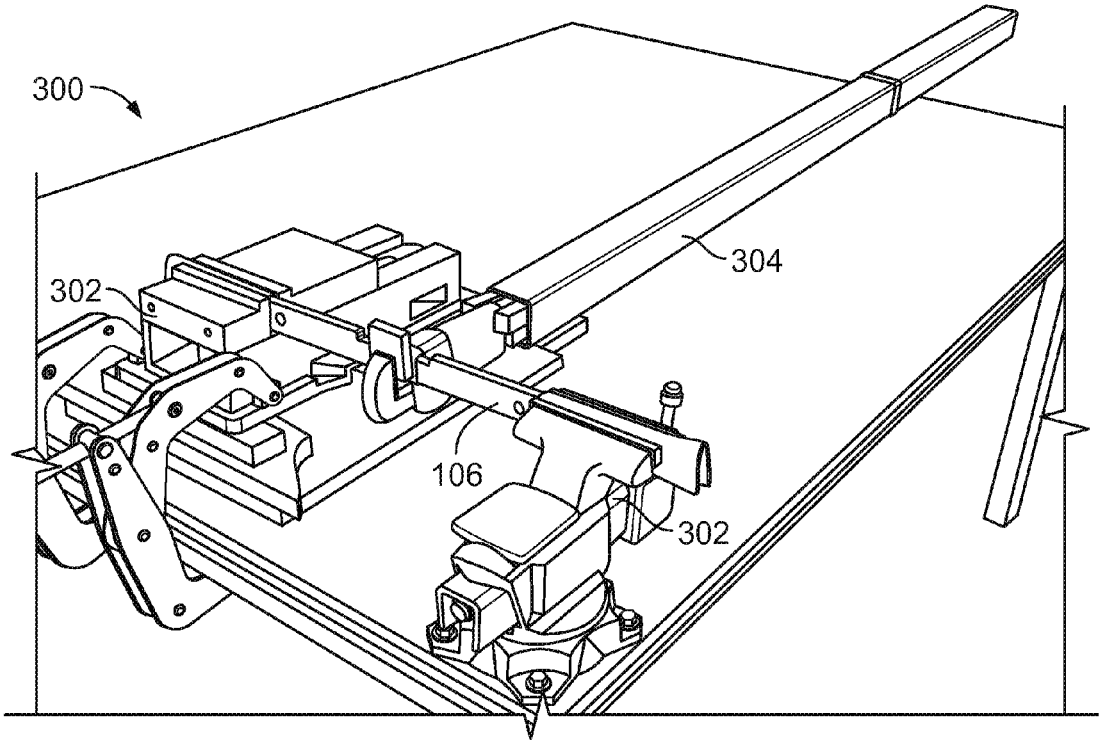

FIG. 9 illustrates a test setup 300 used to perform Test 3. For Test 3, the test side rail 106 was supported between two vices 302 positioned about 300 mm apart from on another. A large cantilever arm 304 was affixed to the center of the test side rail 106 and a torque load of about 150 N-m was applied to the test side rail 106. An observed rail deflection angle under load was then measured with the inclinometer. As indicated in Table 1 above, the maximum deflection was 4 degrees when the load was applied and no permanent deflection was observed in the test side rail 106 when the load was released.

Figure 10:
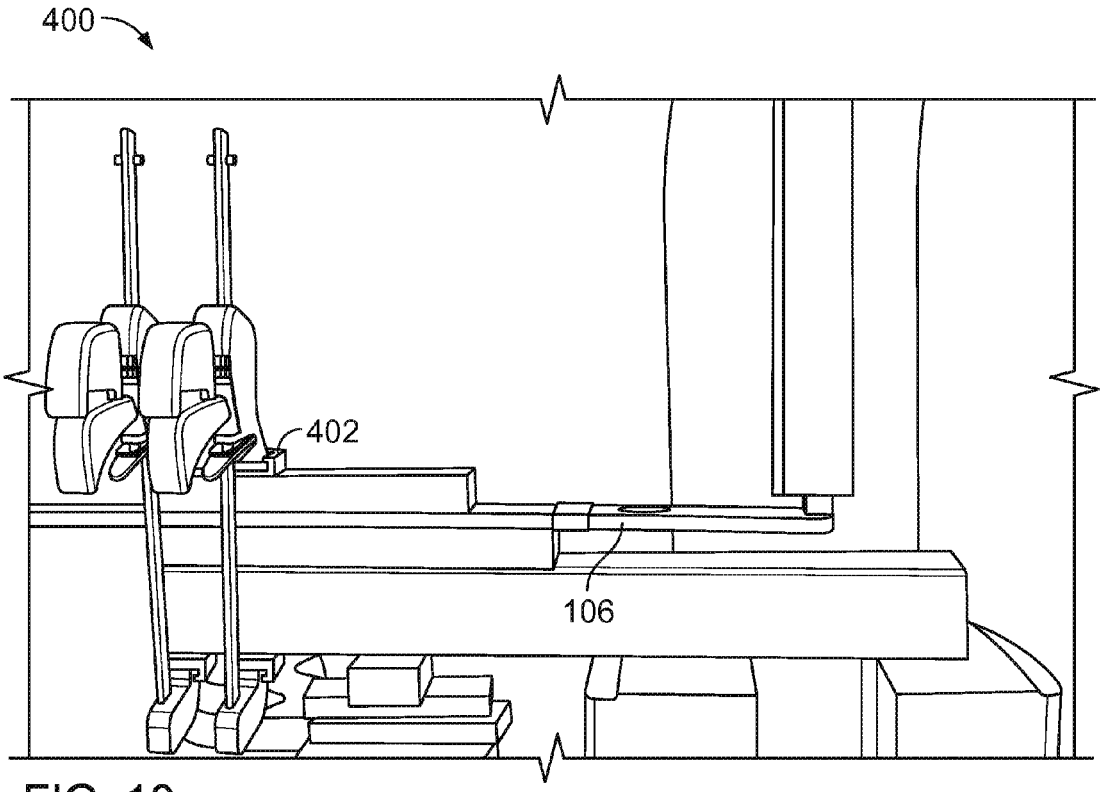

FIG. 10 illustrates a test setup 400 used to perform Tests 4 and 5. A fixture 402 was developed such that the test side rail 106 was securely constrained on one end and a free length of unsupported rail of about 150 mm was cantilevered outwards. A load of about 250 N was then applied at the very tip of the cantilevered test side rail. Any changes of the gap between the fixture 402 and the test side rail 106 were measured before, during, and after loading such that observed deflection and rebound could be established. This setup was used to apply loads to both the narrow and wide faces of the test side rail 106, according to Test Procedures 4 and 5 in Table 1. As indicated in Table 1 above, for Test 4, the maximum deflection was 1.5 mm when the load was applied and no permanent deflection was observed in the test side rail 106 when the load was released. For Test 5, the maximum deflection was 3.5 mm when the load was applied and no permanent deflection was observed in the test side rail 106 when the load was released.

Figure 11:
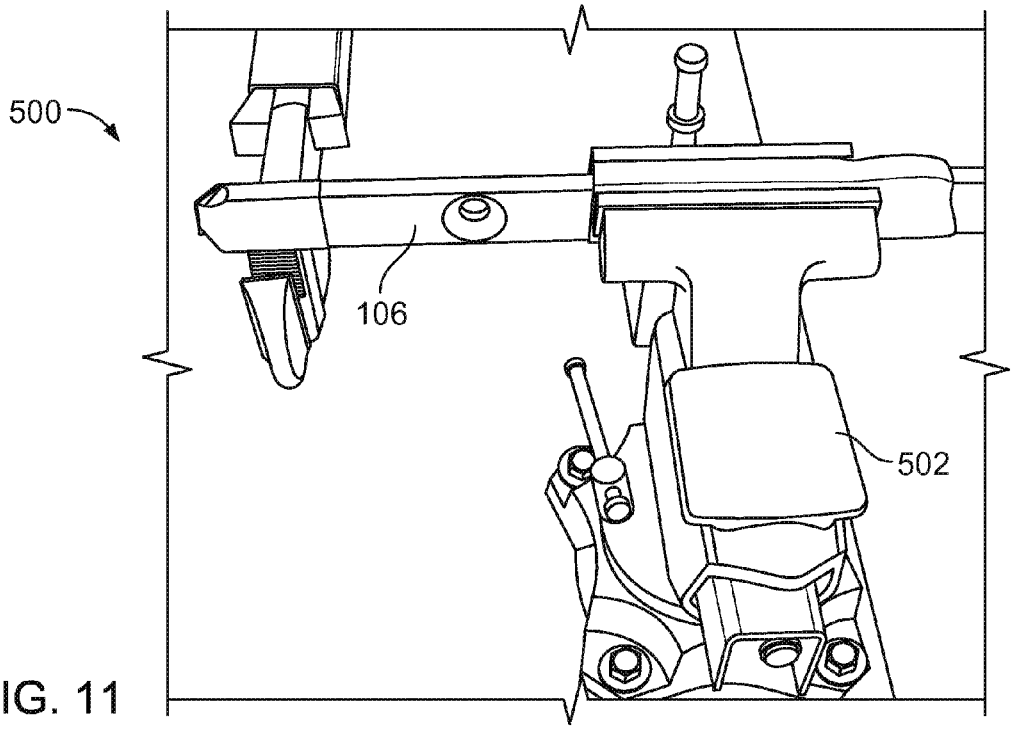

FIG. 11 illustrates a test setup 500 used to perform Test 6. The test side rail 106 was held in a cantilevered configuration such that about 150 mm of the test side rail 106 extended from a vice 502. A torque of about 75 N-m was then applied at the end of the test side rail 106. Deflection of the test side rail 106 that was observed before, during, and after loading was measured with the inclinometer such that angular deflection under load could be established. As indicated in Table 1 above, the maximum deflection was 4 degrees when the load was applied and no permanent deflection was observed in the test side rail 106 when the load was released.

After completing all the tests, the test side rail 106 was visually examined to verify that it was substantially free of permanent deformation. The test side rail 106 was also checked for flatness on the granite inspection table and showed no sign of deformation.

Impact Testing

The test side rail was also impact tested, according to determine and compare the degree to which the test side rail, which was made of nickel plated 7075-T6 aluminum, and another test rail, which was made of conventional 304 stainless steel but had the same dimensions as the test side rail 106, deform relative to one another when struck with substantially equivalent loads. A summary of the test procedure for the impact test of the test side rail are provided below in Table 3.

TABLE 3

| Test No. | Test Procedure |
|---|---|
| 1 | A 120 mm cantilevered length of rail is struck on the end with a 2.25 kg mass dropped from a height of 75 cm. This impact is repeated five times for each sample rail. |

Table 4 provides descriptions of respective test samples that were used during impact testing.

TABLE 4

| Sample No. | Description | Material Composition |
|---|---|---|
| 1 | Aluminum ("Al.") Rail According to FIGS. 4-7 | 7075-T6 Aluminum with Electroless Nickel Coating, Mid Phosphorus, .025 mm thick |
| 2 | Benchmark Stainless Steel ("S.S.") Rail | 304 Stainless Steel |

Figure 12:
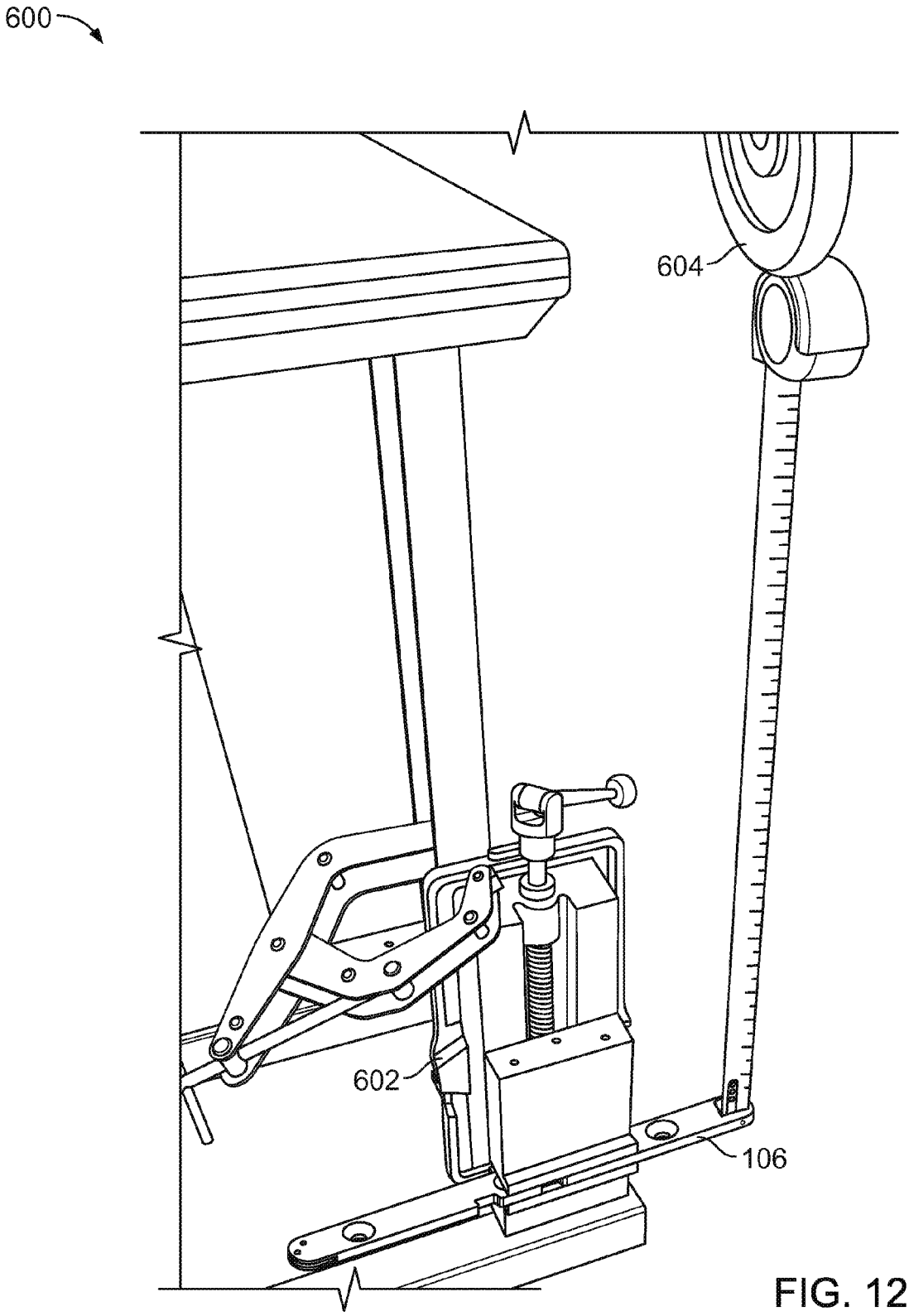
FIG. 12 is a diagram of a test setup used to perform an impact test on the test side rail of FIGS. 4-6.

FIG. 12 illustrates a test setup 600 used to perform the impact testing. Sample 1, made of nickel plated 7075-T6 Aluminum, was clamped to a large vice 602 such that 120 mm of unsupported test side rail 106 protruded outwards away from the vice 602. A mass 604 of 2.25 kilograms was suspended at a height of 75 cm from the test side rail 106 and allowed to fall on the end of the test side rail 106. The test side rail 106 was then inspected for deformation and the resulting maximum deformation of the test side rail 106 was recorded. This process was then repeated a total of 5 times, noting additional increases in deformation after each impact. This process was then repeated for Sample 2, the stainless steel benchmark rail, which had substantially the same size and shape as Sample 1, the nickel plated 7075-T6 aluminum rail.

After completing each impact for both test side rail samples, the test side rails were examined for permanent deformation. The observed test results of the impact testing are provided below in Table 5. Note that the deformation data results provided in Table 5 were recorded as a change in geometry from one impact to the next impact and not the total observed impact.

TABLE 5

| Impact No. | Deformation of Aluminum. Rail | Deformation of Stainless Steel Rail |
|---|---|---|
| 1 | 0.86 mm | 2.08 mm |
| 2 | 0.40 mm | 0.58 mm |
| 3 | 0.05 mm | 0.28 mm |
| 4 | 0.02 mm | 0.23 mm |
| 5 | 0.18 mm | 0.25 mm |
| Average deformation per impact | 0.30 mm | 0.68 mm |

When subjected to equivalent impact forces, Sample 2, the stainless steel rail, was shown to deform an average deformation distance per impact that was over twice as much as the deformation of Sample 1, the nickel plated 7075-T6 aluminum rail. This impact testing demonstrated that a side rail made of nickel plated 7075-T6 aluminum can absorb impact forces without permanently deforming better than certain conventional stainless steel side rails.

Other Embodiments

Figure 13:
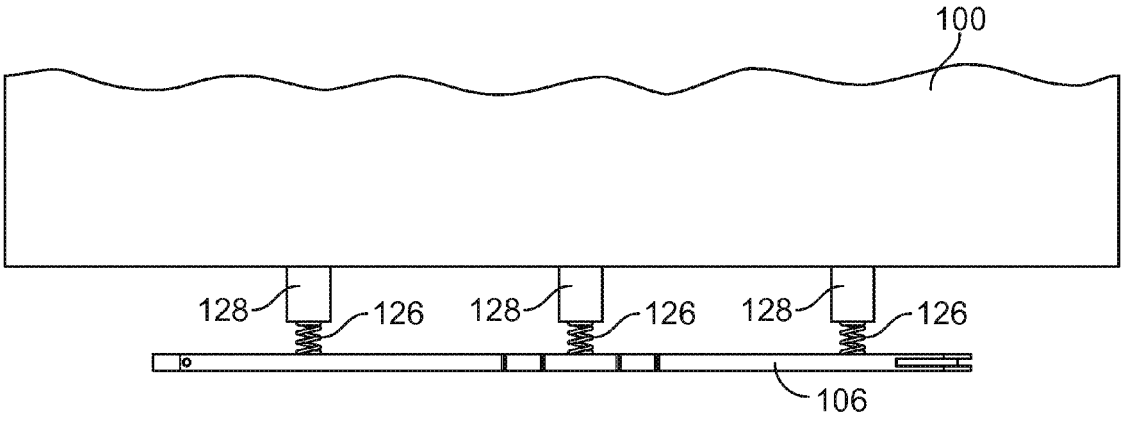
FIG. 13 is a top view of a portion of a medical table that includes force absorbing members disposed between a side rail and standoffs off the table.

While the side rails have been described as being fastened in a substantially rigid manner to the standoffs and, therefore, also to the table, other configurations are possible. For example, as shown in FIG. 13, force absorbing members 126, such as springs (e.g., Belleville washers), are disposed between the side rail 106 and the table. As shown, each of the absorbing members 126 is disposed between the side rail 106 and one of the standoffs 128. Alternatively, the force absorbing members 126 can be disposed between the standoffs 128 and the table 100. The force absorbing members 126 provide a resisting force that limits the extent that the side rail 106 can move relative to the table 100. Thus, an impact force applied to the side rail 106 (e.g., as a result of a collision) can be absorbed by the force absorbing members 126 and the side rail 106 can move towards the table 100 without substantially deforming.

In some embodiments, the spring force constant of each absorbing member 126 is about 50 N/mm to about 200 N/mm. In certain implementations, the side rail 106 equipped with the force absorbing members 126 can withstand energy of about 5 Joules to about 100 Joules (e.g., resulting from an impact force) without experiencing permanent deformation. In some embodiments, the side rail 106 can withstand energy of about 50 Joules to about 100 Joules without experiencing permanent deformation. As an example, the side rail 106 could withstand the impact of a 2 kg mass weight dropped from a height of 1 meter (accelerating at 1 g) without experiencing permanent deformation.

While multiple force absorbing members 126 have been described as being positioned along the side rail, in some embodiments, only one force absorbing member is used. The sole force absorbing member in such embodiments can be positioned on the center standoff.

While the side rail has been described as having a member that defines a generally rectangular cross-sectional shape, other configurations are possible. For example, in some embodiments, the side rail has a cross-sectional shape that is shaped as other polygons (e.g., trapezoids, triangles, pentagons, hexagons, or other polygons), curved shapes (e.g., circles, ellipses, oblong shapes), or other shapes, such as a C-channel, an I-beam, or non-uniform shapes having other curved and/or flat surfaces.

While the side rail has been described as having three mounting holes, the side rail can have more or fewer mounting holes. For example, in some embodiments, the side rail has more than three (e.g., four, five, six, seven, eight, or more) mounting holes. In other embodiments, the side rail has fewer (e.g., two or one) mounting holes.

While the side rail has been described as being attached to the table using fasteners arranged through mounting holes, other attachment devices or techniques can be used. For example, in some embodiments, the side rail is attached to the table using clips, snapping mechanisms, adhesives, welding, or other attachment devices or techniques.

While the side rail has been described as having an accessory lock at one end that can prevent accessories from inadvertently sliding off the side rail, other configurations are possible. For example, in some embodiments, the side rail includes an accessory lock at both ends. In some embodiments, the side rail does not include an accessory lock.

While the table has been described as including three patient support surface segments, other configurations are possible. For example, the table can include fewer (e.g., one or two) patient support segments or more (e.g., four, five, six, seven, or more) patient support surface segments to support the patient in a variety of operating room configurations.

A number of embodiments have been described. Nevertheless, it will be understood that various modifications may be made without departing from the spirit and scope of the invention. Accordingly, other embodiments are within the scope of the following claims.

What is claimed is:

1. A side rail for a medical table, the side rail comprising:

an elongated body having two terminal ends and that is configured, based on at least a height and a width of the elongated body, to be received by a medical accessory, wherein the elongated body is formed of a material having a modulus of elasticity that is about 50 gigapascals to about 150 gigapascals and a yield strength that is about $40\times10^7$ pascals to about $120\times10^7$ pascals, wherein the elongated body comprises a plurality of mounting holes configured to engage respective fasteners for securing the side rail to the medical table, the plurality of mounting holes defining an inter-hole spacing along the elongated body that is based on the height of the elongated body, the width of the elongated body, and mechanical properties of the material from which the elongated body is formed, such that the side rail, according to a structural strength provided by the inter-hole spacing of the plurality of mounting holes, can support the medical accessory and can flex or deflect up to a predetermined amount when an impact force is applied to the side rail, wherein the height is about 20 mm to about 35 mm and the width is about 6 mm to about 20 mm, wherein the inter-hole spacing is about 300 mm or less, and wherein an outer spacing distance between respective outermost holes of the plurality of mounting holes and corresponding terminal ends of the two terminal ends is about 150 mm or less, and a manually controlled accessory lock located at one of the two terminal ends of the elongated body and including a member configured to move inward towards and into the side rail to permit mounting of the medical accessory to the side rail and further configured to move away from the side rail after the medical accessory is mounted so as to block the medical accessory from falling off of the side rail.

2. The side rail according to claim 1, wherein the height is about 25 mm to about 30 mm and the width is about 8 mm to about 10 mm.

3. The side rail according to claim 1, wherein the material has a modulus of elasticity that is about 50 gigapascals to about 80 gigapascals and a yield strength that is about $40\times10^7$ pascals to about $60\times10^7$ pascals.

4. The side rail according to claim 1, wherein the material has a modulus of elasticity that is about 100 gigapascals to about 130 gigapascals and a yield strength that is about $100\times10^7$ pascals to about $120\times10^7$ pascals.

5. The side rail according to claim 1, further comprising a metal plating that substantially covers the elongated body.

6. The side rail according to claim 5, wherein the metal plating comprises a nickel based material.

7. The side rail according to claim 6, wherein the metal plating is an electroless nickel plating that is about 0.025 mm thick.

8. The side rail according to claim 1, wherein the side rail defines a first wide side and a second wide side that is opposite the first wide side, the side rail being configured such that when the side rail is supported along the first wide side by two support members that are about 300 mm apart and a 500 newton force is applied midway between the support members to the second wide side, the side rail has a maximum deflection of less than about 5 mm and rebounds without substantially any permanent deformation when the force is released.

9. The side rail according to claim 1, wherein the medical table is an operating room table.

10. The side rail according to claim 1, wherein the material from which the elongated body is formed comprises an aluminum alloy or a titanium alloy having the modulus of elasticity that is about 50 gigapascals to about 150 gigapascals and the yield strength that is about $40\times10^7$ pascals to about $120\times10^7$ pascals.

11. The side rail according to claim 1, wherein each of the plurality of mounting holes is centered along a horizontal centerline of the elongated body.

12. The side rail according to claim 1, wherein the side rail, according to a structural strength provided by the outer spacing distance between the respective outermost holes of the plurality of mounting holes and the corresponding terminal ends of the two terminal ends, can support the medical accessory when the medical accessory is secured near the corresponding terminal end of the elongated body, and can flex or deflect up to the predetermined amount when the impact force is applied to the side rail.

13. The side rail according to claim 1, wherein the material comprises Al 7075-T6, and the side rail, according to the structural strength provided by the inter-hole spacing of the plurality of mounting holes, deforms on average by a distance of less than half a distance that a steel side rail of a substantially equivalent geometry deforms when the impact force is applied to the side rail and to the steel side rail.

14. A medical table system comprising:

a table that is configured to support a patient during a medical procedure, the table defining a patient support surface; and a side rail disposed along an outer surface of the table, the side rail comprising an elongated body having two terminal ends and that is configured, based on at least a height and a width of the elongated body, to be received by a medical accessory, wherein the elongated body is formed of a material having a modulus of elasticity that is about 50 gigapascals to about 150 gigapascals and a yield strength that is about $40\times10^7$ pascals to about $120\times10^7$ pascals, and wherein the elongated body comprises a plurality of mounting holes configured to engage respective fasteners for securing the side rail to the table, the plurality of mounting holes defining an inter-hole spacing along the elongated body that is based on the height of the elongated body, the width of the elongated body, and mechanical properties of the material from which the elongated body is formed, such that the side rail, according to a structural strength provided by the inter-hole spacing of the plurality of mounting holes, can support the medical accessory and can flex or deflect up to a predetermined amount when an impact force is applied to the side rail, wherein the height is about 20 mm to about 35 mm and the width is about 6 mm to about 20 mm, wherein the inter-hole spacing is about 300 mm or less, and wherein an outer spacing distance between respective outermost holes of the plurality of mounting holes and corresponding terminal ends of the two terminal ends is about 150 mm or less, and a manually controlled accessory lock located at one of the two terminal ends of the elongated body and including a member configured to move inward towards and into the side rail to permit mounting of the medical accessory to the side rail and further configured to move away from the side rail after the medical accessory is mounted so as to block the medical accessory from falling off of the side rail.

15. The medical table system according to claim 14, wherein the height is about 25 mm to about 30 mm and the width is about 8 mm to about 10 mm.

16. The medical table system according to claim 14, wherein the material has a modulus of elasticity that is about 50 gigapascals to about 80 gigapascals and a yield strength that is about $40\times10^7$ pascals to about $60\times10^7$ pascals.

17. The medical table system according to claim 14, wherein the material has a modulus of elasticity that is about 100 gigapascals to about 130 gigapascals and a yield strength that is about $100\times10^7$ pascals to about $120\times10^7$ pascals.

18. The medical table system according to claim 14, further comprising a metal plating that substantially covers the elongated body.

19. The medical table system according to claim 18, wherein the metal plating comprises a nickel based material.

20. The medical table system according to claim 19, wherein the metal plating is an electroless nickel plating that is about 0.025 mm thick.

21. The medical table system according to claim 14, wherein the side rail is configured to withstand an impact force of about 500 newtons that is applied midway between two side rail supports on which the side rail is supported, the supports being spaced about 300 millimeters apart from one another.

22. The medical table system according to claim 14, wherein the table is an operating room table.

23. The medical table system according to claim 14, wherein the material from which the elongated body is formed comprises an aluminum alloy or a titanium alloy having the modulus of elasticity that is about 50 gigapascals to about 150 gigapascals and the yield strength that is about $40\times10^7$ pascals to about $120\times10^7$ pascals.

24. The medical table system according to claim 14, wherein each of the plurality of mounting holes is centered along a horizontal centerline of the elongated body.

25. The medical table system according to claim 14, wherein the side rail, according to a structural strength provided by the outer spacing distance between the respective outermost holes of the plurality of mounting holes and the corresponding terminal ends of the two terminal ends, can support the medical accessory when the medical accessory is secured near the corresponding terminal end of the elongated body, and can flex or deflect up to the predetermined amount when the impact force is applied to the side rail.

26. The medical table system according to claim 14, wherein the material comprises Al 7075-T6, and the side rail, according to the structural strength provided by the inter-hole spacing of the plurality of mounting holes, deforms on average by a distance of less than half a distance that a steel side rail of a substantially equivalent geometry deforms when the impact force is applied to the side rail and to the steel side rail.

27. A side rail for a medical table, the side rail comprising:

an elongated body having two terminal ends and that is configured, based on at least a height and a width of the elongated body, to be received by a medical accessory, wherein the elongated body comprises a plurality of mounting holes configured to engage respective fasteners for securing the side rail to the medical table, the plurality of mounting holes defining an inter-hole spacing along the elongated body that is based on the height of the elongated body, the width of the elongated body, and mechanical properties of a material from which the elongated body is formed, such that the side rail, according to a structural strength provided by the inter-hole spacing of the plurality of mounting holes, can support the medical accessory, wherein the side rail defines a first wide side and a second wide side that is opposite the first wide side, the side rail being configured such that when the side rail is supported along the first wide side by two support members that are about 300 mm apart and a 500 newton force is applied midway between the support members to the second wide side, the side rail, according to the structural strength provided by the inter-hole spacing of the plurality of mounting holes, has a maximum deflection that is less than about 5 mm and rebounds without substantially any permanent deformation of the side rail when the force is released, wherein the height is about 20 mm to about 35 mm and the width is about 6 mm to about 20 mm, wherein the inter-hole spacing is about 300 mm or less, and wherein an outer spacing distance between respective outermost holes of the plurality of mounting holes and corresponding terminal ends of the two terminal ends is about 150 mm or less, and a manually controlled accessory lock located at one of the two terminal ends of the elongated body and including a member configured to move inward towards and into the side rail to permit mounting of the medical accessory to the side rail and further configured to move away from the side rail after the medical accessory is mounted so as to block the medical accessory from falling off of the side rail.

28. The side rail according to claim 27, wherein the maximum deflection is less than about 3.0 mm.

29. The side rail according to claim 27, wherein the height is about 25 mm to about 30 mm and the width is about 8 mm to about 10 mm.

30. The side rail according to claim 27, wherein the medical table is an operating room table.

31. The side rail according to claim 27, wherein the material from which the elongated body is formed comprises an aluminum alloy or a titanium alloy having a modulus of elasticity that is about 50 gigapascals to about 150 gigapascals and a yield strength that is about $40\times10^7$ pascals to about $120\times10^7$ pascals.

32. The side rail according to claim 27, wherein each of the plurality of mounting holes is centered along a horizontal centerline of the elongated body.

33. The side rail according to claim 27, wherein the side rail, according to a structural strength provided by the outer spacing distance between the respective outermost holes of the plurality of mounting holes and the corresponding terminal ends of the two terminal ends, can support the medical accessory when the medical accessory is secured near the corresponding terminal end of the elongated body, and wherein when the side rail is supported along the first wide side by the two support members and the 500 newton force is applied midway between the two support members to the second wide side, the side rail, according to the structural strength provided by the outer spacing of the outer holes, has a maximum deflection that is less than about 5 mm and rebounds without substantially any permanent deformation of the side rail when the force is released.

34. The side rail according to claim 27, wherein the material comprises Al 7075-T6, and the side rail, according to the structural strength provided by the inter-hole spacing of the plurality of mounting holes, deforms on average by a distance of less than half a distance that a steel side rail of a substantially equivalent geometry deforms when the impact force is applied to the side rail and to the steel side rail.

35. A medical table system comprising:

a table that is configured to support a patient during a medical procedure, the table defining a patient support surface; and a side rail disposed along an outer surface of the table, the side rail comprising:

an elongated body having two terminal ends and that is configured, based on at least a height and a width of the elongated body, to be received by a medical accessory, and a force absorbing member securing the side rail to the table, wherein the elongated body comprises a plurality of mounting holes configured to engage respective fasteners for securing the side rail to the table, the plurality of mounting holes defining an inter-hole spacing along the elongated body that is based on the height of the elongated body, the width of the elongated body, and mechanical properties of a material from which the elongated body is formed, such that the side rail, according to a structural strength provided by the inter-hole spacing of the plurality of mounting holes and a configuration of the force absorbing member, can support the medical accessory and deflects towards the table when energy of about 5 Joules to about 100 Joules is applied to the side rail in the form of an impact force and absorbs some of the energy applied to the side rail as the side rail deflects towards the table, wherein the height is about 20 mm to about 35 mm and the width is about 6 mm to about 20 mm, wherein the inter-hole spacing is about 300 mm or less, and wherein an outer spacing distance between respective outermost holes of the plurality of mounting holes and corresponding terminal ends of the two terminal ends is about 150 mm or less, and a manually controlled accessory lock located at one of the two terminal ends of the elongated body and including a member configured to move inward towards and into the side rail to permit mounting of the medical accessory to the side rail and further configured to move away from the side rail after the medical accessory is mounted so as to block the medical accessory from falling off of the side rail.

36. The medical table system according to claim 35, wherein the force absorbing member provides a resisting force having a spring force constant that is about 50 N/mm to about 200 N/mm.

37. The medical table system according to claim 35, wherein the force absorbing member is a spring.

38. The medical table system according to claim 37, wherein the spring is a spring washer.

39. The medical table system according to claim 37, wherein the spring force constant of the spring is about 50 N/mm to about 200 N/mm.

40. The medical table system according to claim 35, wherein the side rail, according to the structural strength provided by the inter-hole spacing of the plurality of mounting holes and the configuration of the force absorbing member, deflects towards the table when the energy applied to the side rail in the form of the impact force is about 50 Joules to about 100 Joules.

41. The medical table system according to claim 35, wherein the table is an operating room table.

42. The medical table system according to claim 35, wherein the material from which the elongated body is formed comprises an aluminum alloy or a titanium alloy having a modulus of elasticity that is about 50 gigapascals to about 150 gigapascals and a yield strength that is about $40\times10^7$ pascals to about $120\times10^7$ pascals.

43. The medical table system according to claim 35, wherein each of the plurality of mounting holes is centered along a horizontal centerline of the elongated body.

44. The medical table system according to claim 35, wherein the side rail, according to a structural strength provided by the outer spacing distance between the respective outermost holes of the plurality of mounting holes and the corresponding terminal ends of the two terminal ends, can support the medical accessory when the medical accessory is secured near the corresponding terminal end of the elongated body and deflects towards the table when energy of about 5 Joules to about 100 Joules is applied to the side rail in the form of the impact force and absorbs some of the energy applied to the side rail as the side rail deflects towards the table.

45. The medical table system according to claim 35, wherein the material comprises Al 7075-T6, and the side rail, according to the structural strength provided by the inter-hole spacing of the plurality of mounting holes, deforms on average by a distance of less than half a distance that a steel side rail of a substantially equivalent geometry deforms when the impact force is applied to the side rail and to the steel side rail.

* * * * *